US005337498A

United States Patent [19]

Smith

[11] Patent Number: 5,337,498

[45] Date of Patent: Aug. 16, 1994

[54] DRYING APPARATUS WITH AIR DIRECTION ARRANGEMENT

[75] Inventor: Colin Smith, Epsom, United Kingdom

[73] Assignee: British Gas plc, England

[21] Appl. No.: 880,661

[22] Filed: May 11, 1992

[30] Foreign Application Priority Data

May 10, 1991 [GB] United Kingdom ..... 9110137.8

[51] Int. Cl.[5] ..... F26B 3/00

[52] U.S. Cl. ..... 34/487; 34/225; 34/523; 432/187

[58] Field of Search ..... 34/35, 86, 22, 29, 38, 34/34, 225, 243 R, 237, 204, 239, 133 R; 432/187; 431/158

[56] References Cited

U.S. PATENT DOCUMENTS

| | | | |
|---|---|---|---|
| 2,604,313 | 7/1952 | Grantham | 34/133 R |
| 2,630,311 | 3/1953 | Bloxham | 432/187 |
| 2,675,459 | 4/1954 | Pace | 34/243 R |
| 2,884,708 | 5/1959 | Levitt | 34/237 |
| 3,007,256 | 11/1961 | Rouy | 34/239 |
| 4,011,041 | 3/1977 | Taylor . | |
| 4,203,229 | 5/1980 | Southworth . | |
| 4,812,621 | 3/1989 | Brotherton et al. | 34/243 R |
| 4,827,627 | 5/1989 | Cardoso | 34/44 |

FOREIGN PATENT DOCUMENTS

| | | | |
|---|---|---|---|
| 0329922 | 8/1989 | European Pat. Off. . | |
| 1951195 | 4/1971 | Fed. Rep. of Germany | 34/243 R |
| 1964289 | 6/1971 | Fed. Rep. of Germany | 34/243 R |
| 2808239 | 8/1979 | Fed. Rep. of Germany | 34/243 R |
| 2337536 | 1/1976 | France . | |
| 1513356 | 10/1989 | U.S.S.R. . | |
| 584453 | 7/1944 | United Kingdom . | |
| 766616 | 1/1955 | United Kingdom . | |
| 2143012 | 1/1985 | United Kingdom | 34/243 R |

*Primary Examiner*—Denise Gromada
*Attorney, Agent, or Firm*—Larson and Taylor

[57] ABSTRACT

Apparatus for drying utensils comprises a chamber 1 and a gas-fired burner 20, such as a fully premixed burner, for firing into the chamber. Fans 30 blow air into the chamber and deflectors 31 direct air from the fans 30, via openings 43, to mix with the hot gaseous combustion products produced by the burner 20 to provide a hot mixture. A duct portion 7 directs the hot gaseous mixture from the chamber into a drying region 9 and over the utensils which pass through the drying region to be dried. The hot mixture is used to dry the utensils by direct contact.

13 Claims, 6 Drawing Sheets

DRYING APPARATUS WITH AIR DIRECTION ARRANGEMENT

The present invention relates to drying apparatus and, more particularly, to apparatus for drying objects, such as dishes, plates, cups, saucers and other utensils.

Such apparatuses incorporating electrical heaters to provide heat to dry such utensils are well-known. One known electrically-powered washing and drying machine comprises one or more washing sections, a washing and rinse section and one or more drying sections through which the utensils are conveyed sequentially. Typically, a drying section might have two electrical resistance heating element units, each having air blown over them by centrifugal fans, the air being heated by the heating elements. The hot air is then channelled through a slot on to the utensils passing through the drying section.

An object of this invention is to provide apparatus which utilises hot gaseous combustion products obtained by burning fuel gas to dry objects by direct contact.

According to the invention apparatus for drying objects comprises a chamber, a gas-fired burner for firing into the chamber, at least one means for delivering air into the chamber, means for directing air from the or one or more of the air delivering means to mix with hot gaseous combustion products produced by the burner, and a region for receiving objects to be dried, the chamber having an outlet means for directing a mixture of the combustion products and air into the region. Thus, the hot mixture of gaseous combustion products and air is used to dry the objects directly, that is without employing heat exchangers which utilise the hot mixture to heat the drying region indirectly and thus dry the objects indirectly.

Preferably, the gas-fired burner is a fully premixed burner, that is a burner in which all of the air required for complete and satisfactory combustion is delivered under pressure (e.g. supplied by a fan) and mixed with the fuel gas prior to the latter passing through the burner ports.

Fully premixed combustion is more intense than partially aerated combustion and results in a compact flame with a smaller burn-out volume, that is the flame burns closer to the burner face or surface which supports the flame. Additionally, the use of a fully premixed burner provides an advantage in that it does not have to fire vertically upwardly, but may be arranged to fire in any direction, such as in a substantially horizontal direction or even in a downwardly direction.

As a result of the compact flames associated with fully premixed burners, there is substantial reduction or elimination of the quenching of chemical reactions associated with the burning flame on relatively cold surfaces in the vicinity of the burner or by relatively cold air. This substantial reduction or elimination of the quenching of chemical reactions provides the advantage that the likelihood of incomplete combustion or unacceptable levels of carbon monoxide is reduced. Moreover, emissions of other pollutant gases, such as oxides of nitrogen (NOx) are inherently lower in the combustion products from fully premixed burners than from usual partially aerated burners.

The fully premixed burner employed may be a known and so-called ribbon burner. That is a burner having a flamestrip made up of alternating and abutting suitable corrugated (such as stainless steel) ribbons and planar separators defining therebetween the burner ports and supported within a framework. Other fully premixed burners may however be employed, for example a surface combustion, radiant or plaque burner.

The outlet means may comprise duct means having an outlet opening and the duct means may taper in the direction towards the outlet opening.

In a preferred embodiment of the apparatus, the outlet means is arranged to direct the mixture of gaseous combustion products and air downwardly into the drying region.

The apparatus may further comprise additional air directing means for directing air from the or one or more of the air delivering means over one or more outer surfaces of the burner housing or casing. This enables the outer surfaces and the surroundings to be cooled.

Conveniently, the air directing means and/or the additional air directing means may comprise one or more deflectors for deflecting air delivered into the chamber. The or each such deflector may be a fixed or stationary structure, and may be of channel form with the mouth of the channel opening towards the air delivering means.

The air directing means and the additional air directing means may be located side-by-side, and where they are both of channel forms they may have a common side wall.

The apparatus may include supporting means which is operable to transport the objects through the drying region.

Applicants investigations have shown that some electrically-powered drying apparatuses may be converted so as to comprise a gas fired burner instead to provide the heat, with only a relatively small amount of modification required.

The invention will now be described, by way of example, with reference to the accompanying schematic drawings, in which.

Figure 1:
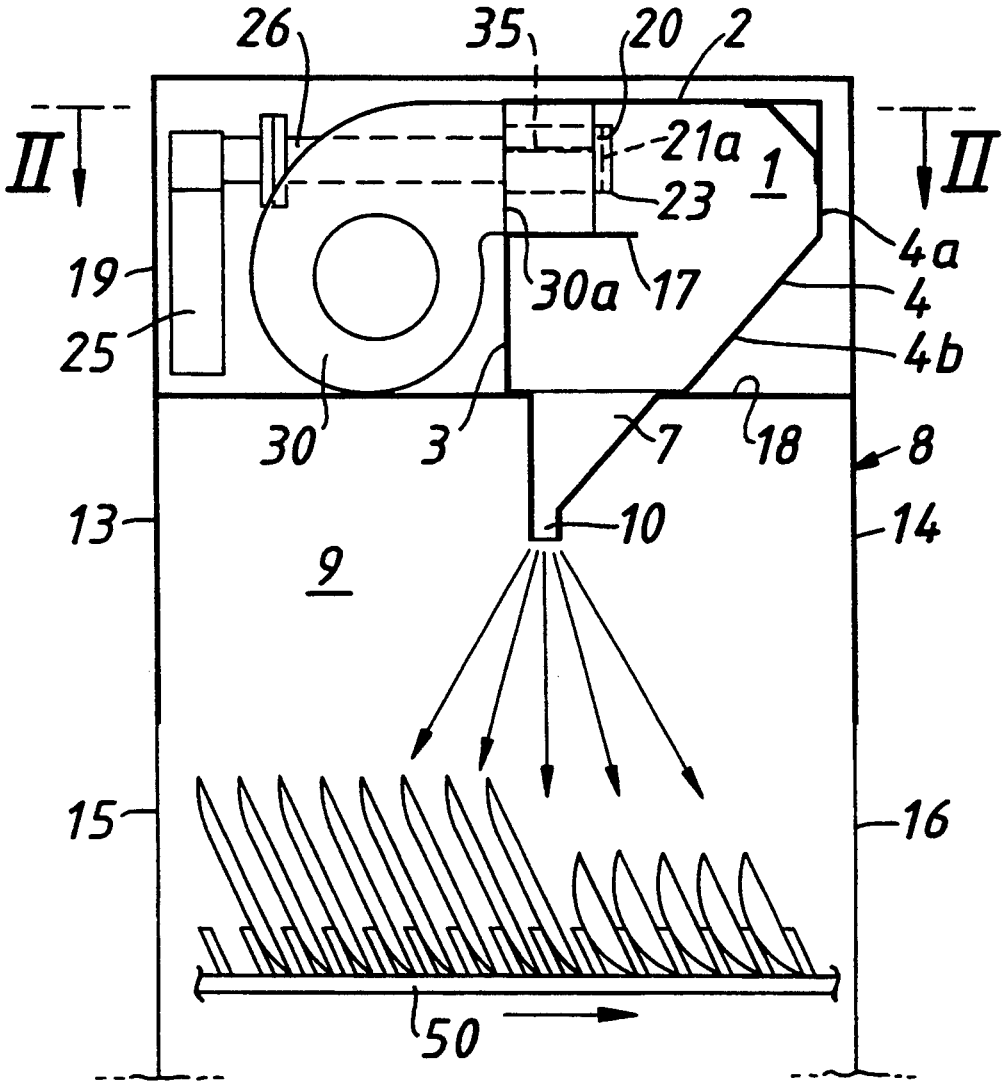
FIG. 1 is a side view of one embodiment of apparatus, for drying utensils, according to the invention.
Figure 2:
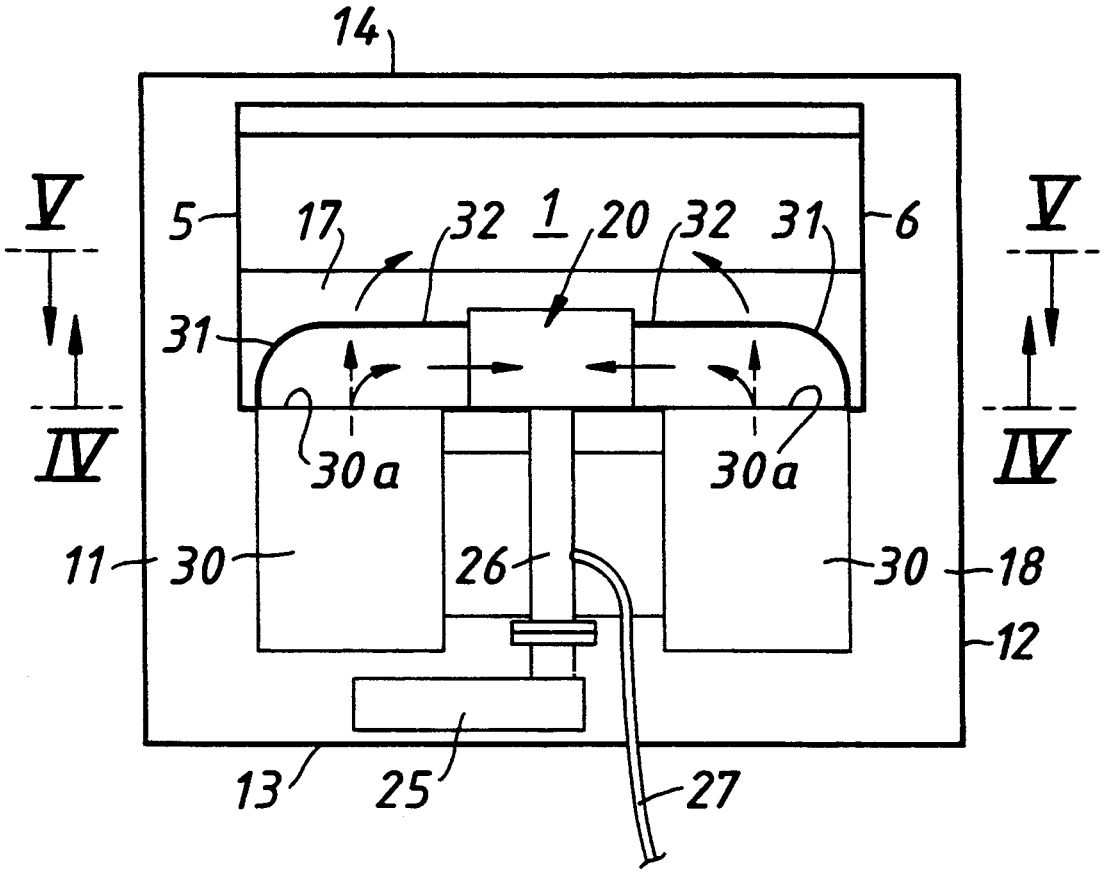
FIG. 2 is a plan view taken on the line II—II in FIG. 1.
Figure 3:
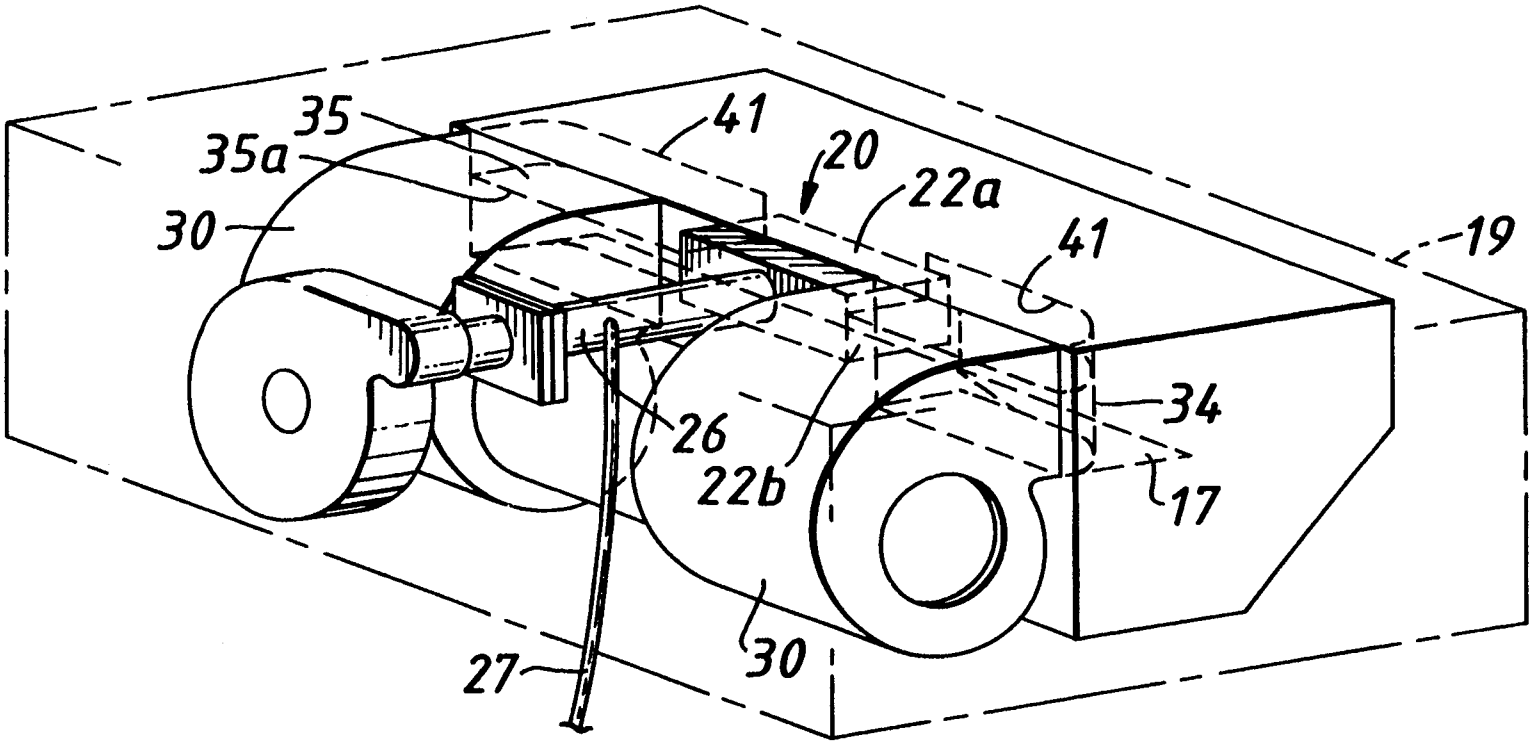
Figure 4:
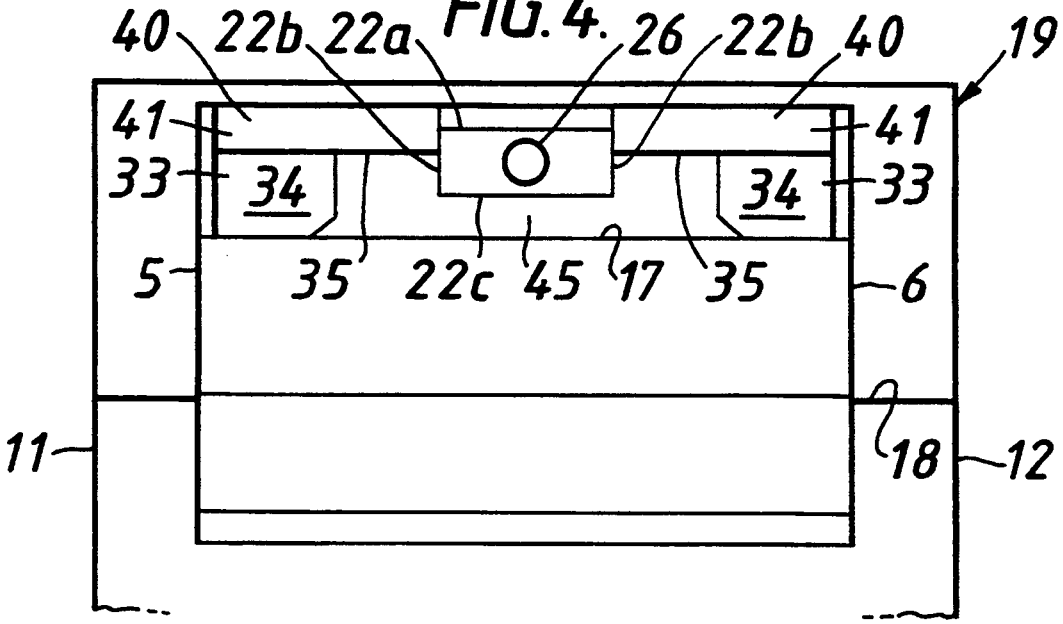
Figure 5:
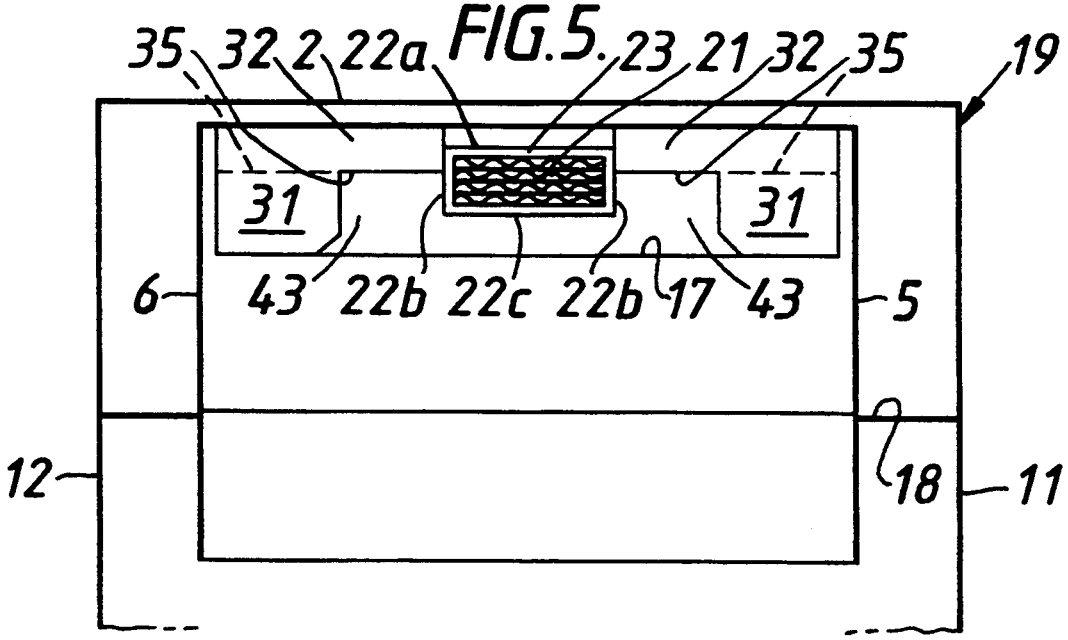
Figure 6:
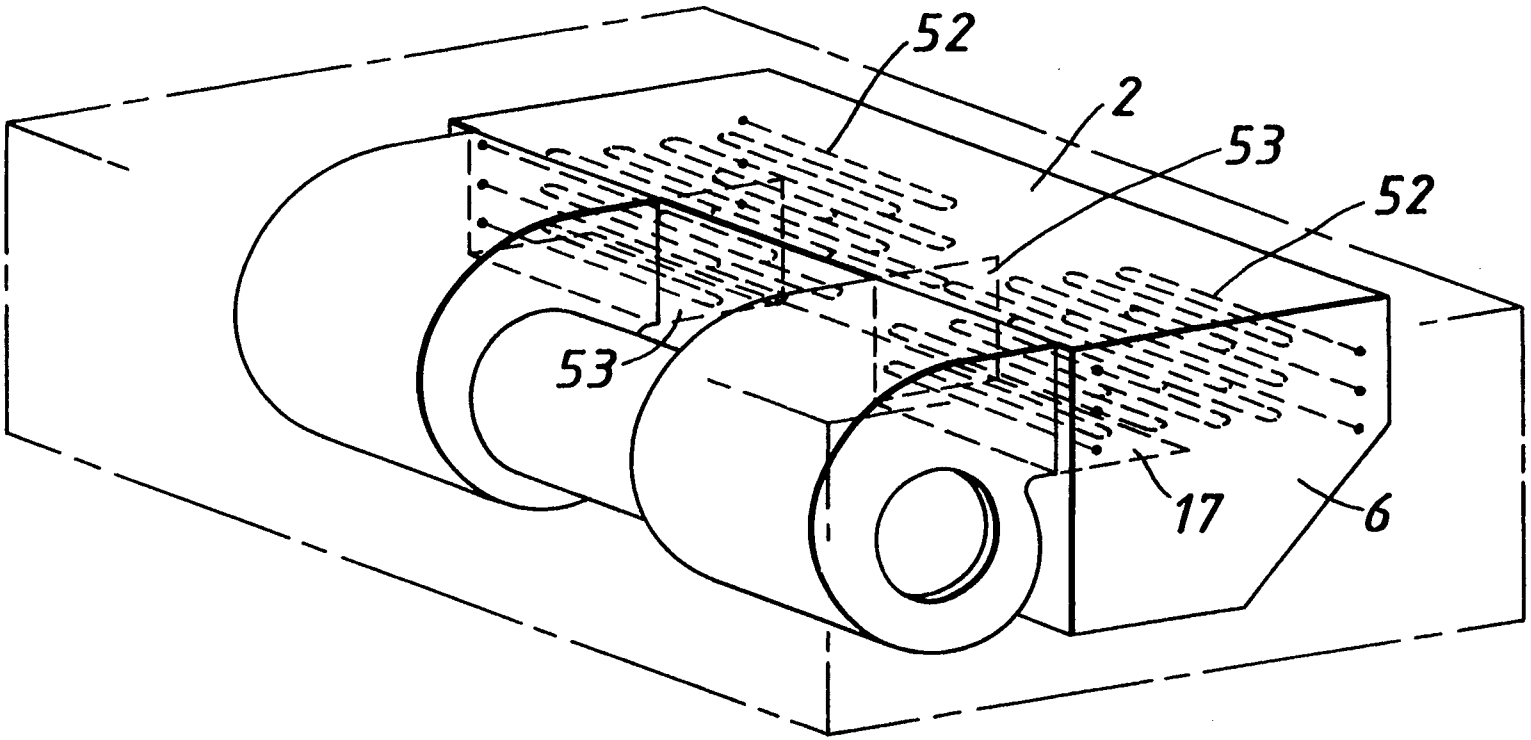

FIG. 3 is a rear perspective view from above of the upper parts of the apparatus with the top cover omitted, FIG. 4 is a sectional view taken on the line IV—IV in FIG. 2, FIG. 5 is a sectional view taken on the line V—V in FIG. 2, FIG. 6 is a rear perspective view from above similar to FIG. 3 but of an electrically heated apparatus prior to modification to produce the embodiment of apparatus as shown in FIGS. 1 to 5, and FIG. 7 illustrates a washing and drying machine which includes apparatus according to the present invention to provide a drying zone.

With reference to FIGS. 1 to 5 of the drawings, apparatus for drying objects, such as dishes, plates and other utensils, comprises a chamber 1 having an upper wall 2, a rear wall 3, a front wall 4 and side walls 5 and 6. The upper portion 4*a* of the front wall is vertical whilst the lower portion 4*b* extends downwardly from the upper portion and towards the rear wall 3. The lower portion 4*b* of the front wall and the rear wall 3 together with the side walls 5 and 6 define a duct portion 7 which tapers and extends downwardly into an enclosure 8 which provides a drying region 9 in which the utensils are dried.

The lower ends of the walls 3 and 4 define therebetween an opening from the duct portion 7 in the form of a slot 10 which extends across the width of the chamber 1.

The enclosure 8 has supporting side walls 11 and 12, which are outwardly of and parallel to respective side walls 5 and 6, a rear wall 13 and front wall 14. The rear and front walls 13 and 14 terminate short of the bottom of the side walls 11 and 12 to leave rear and front openings 15 and 16 respectively. The openings 15 and 16 allow the objects to be dried to be passed into and out of the drying region 9.

Across the width of the chamber a horizontal shelf or ledge 17 extends from the rear wall 3 towards, and terminates well before, the front wall 4, at approximately the level of the junction of the upper wall portion 4*a* and the lower portion 4*b*.

The chamber 1 is supported by the top wall 18 of the enclosure 8 and is itself normally concealed by a top cover 19 which is supported by the enclosure 8.

Between and spaced from the top 2 of the chamber and the ledge 17, a ribbon burner 20 having a stainless steel flamestrip 21 is mounted in a slot in the rear wall 3 centrally between the side walls 5,6. The face 21*a* of the ribbon flamestrip 21 is planar and vertically disposed such that the burner fires substantially horizontally sidewards into the chamber 1. The burner casing or housing 22 includes a perimeter wall 23 which surrounds and stands proud of the face 21*a* of the ribbon flamestrip 21 to facilitate good stability of the burner flame at the edges of the flamestrip. In use the burner produces a flat or planar, blue flame which also lies in a substantially vertical plane.

Mounted outside and at the back of the chamber above the enclosure 8 there is an air supply fan 25 for supplying combustion air to the burner 20 via pipe 26. A line 27 for supplying fuel gas to the burner is connected to, and feeds the gas into, the pipe 26. Thus the pipe 26 serves to supply both air and fuel gas to the burner.

Two centrifugal fans or blowers 30, one to each side of the burner 20, are mounted at the back of the chamber 1 to blow air between the ledge 17 and the top wall 2 into the chamber for mixing with hot combustion products produced by the burner.

As will be appreciated from FIGS. 1, 2 and 3 the cover 19 also covers over equipment mounted at the back of the chamber 1.

On each side of the burner between the ledge 17 and the top wall 2 there are air deflectors 31 and 32 located generally opposite the outlets 30*a* of the respective centrifugal fans 30 and, in part, generally transverse to the direction in which the fans deliver or blow out air.

The deflectors 31 are primarily for directing air delivered into the chamber generally forwardly of the burner face 21*a* so as to enhance mixing of the air and the hot gaseous combustion products. Each deflector 31 is made of plate or sheet metal and is in the form of a channel 33 having a concave base 34 facing the associated fans 30. The base is vertically disposed, extends in the longitudinal direction horizontally from one side of the respective outlet 30*a* adjacent the side wall 5 or 6 and curves round to terminate part way across and forwardly of the outlet 30*a* of the associated fan 30 and short of the burner casing 22. The side walls of the channel 33 between which the base 34 is defined, comprise respectively a portion of the horizontal ledge 17 and a wall 35 which extends parallel to the ledge 17 and terminates at a straight edge 35*a* lying substantially in the plane of the outlet of the associated fan 30.

The two deflectors 32 are for directing air delivered into the chamber over the upper surface 22*a* of the burner casing 22. Each deflector 32 is also of plate or sheet metal and of channel form 40. The bases 41 of each channel 40 is vertically disposed and extends longitudinally horizontally. Each base 41 is integral with the base 34 of the associated channel 33. However, the bases 41 extend around further than the bases 34 and terminate substantially at the side walls 22*b* of the burner casing 22. The side walls of the channel 40 between which the base 41 is defined comprise a portion of the top side 2 of the chamber and the wall 35. Thus the side wall 35 is common to both channels 33 and 40.

Openings 43 on the opposite sides of the burner casing 22 are bounded by the channel bases 41, the terminal edges of the channel bases 34, the upper side of the ledge 17, and the side walls 22*b* of the burner casing. The openings 43 provide outlets via which air delivered by the fan 30 into the channel 33 exits to mix with the hot gaseous combustion products from the burner 20. A portion of the air delivered by the fans 30 is directed by the channel 33 through the gap 45 between the ledge 17 and the lower surface 22*c* of the burner casing 22 and this helps to keep the surfaces relatively cool.

When the apparatus is used the continual delivery of air by the fans 30 into the chamber causes the hot mixture of the gaseous combustion products and the air to move downwardly through the slot 10 and into the drying region 9.

The utensils to be dried may be supported on a conveyor 50 which is operable to transport the utensils into, through and out of the drying region 9.

Although not shown in the drawings it will be appreciated that in practice the apparatus would be provided with controls for adjusting the heat output from the burner 20 (i.e. the gas rate) and/or controls for adjusting the volume of drying air delivered by the fans 30, so that the temperature of the mixture of gaseous combustion products and air which is directed into the drying region 9 can be adjusted within limits, as required by the users.

The Applicants arrangement of the deflectors and other features of the apparatus was such that the temperature of the hot mixture of combustion products and air at any point along the length of the duct outlet opening 10 was generally the same.

Also, the combustion air supplied to the burner by the fan 25 may be regulated by passing such air through a graduated orifice plate (not shown) and/or by adjusting the speed of the fan. The combustion process itself may be controlled by a known safety sequence controller (not shown).

The Applicants constructed an embodiment of apparatus as shown in FIGS. 1 to 5 by modifying an electrically heated apparatus similar to that indicated in FIG. 6 which shows only the top part of the apparatus since the lower part is the same as already described. The apparatus comprises the same centrifugal fans 30 as before, but they blow air onto two respective 6 kW electrical heating element units 52. Plates 53 assist defining with a portion of a respective side wall 5 or 6, a portion of the top wall 2 and the ledge 17 a straight path from the outlets of the fans 30 for the air blown from the fans to the heating elements 52. Such elements are capable of heating the air to about 110° to 135° C. (depending on the nature of the utensils being dried). The electrical power requirement needed to raise the blown air to a sufficient temperature is such that a 3-phase, 415 volt a.c. supply is necessary in the vicinity of the apparatus.

In the Applicants converted apparatus described earlier a single 12 kW premixed ribbon burner was used in place of the two 6 kW heating element units 52.

A number of advantages were observed when the Applicants gas-fired converted apparatus was used instead of the electrically powered apparatus. Based on the present prices of mains supplied fuel gas and electricity, the cost of running Applicants apparatus is significantly cheaper. The requirement for a 3-phase electrical supply to the apparatus is eliminated. It is believed that the lifetime of the heating unit would be longer since Applicants consider that a well-designed and fabricated ribbon burner has a longer life-span than electrical heating elements. The heating output capability of the gas-fired apparatus can be varied in a relatively simple manner.

It will be appreciated that the design, size and location of the deflectors depend on the construction and design of the particular apparatus in which the deflectors are to be used. Therefore, in practice, it may be necessary initially to test deflectors of various shapes and sizes and in various positions and orientations in order to establish suitable arrangements.

Figure 7:
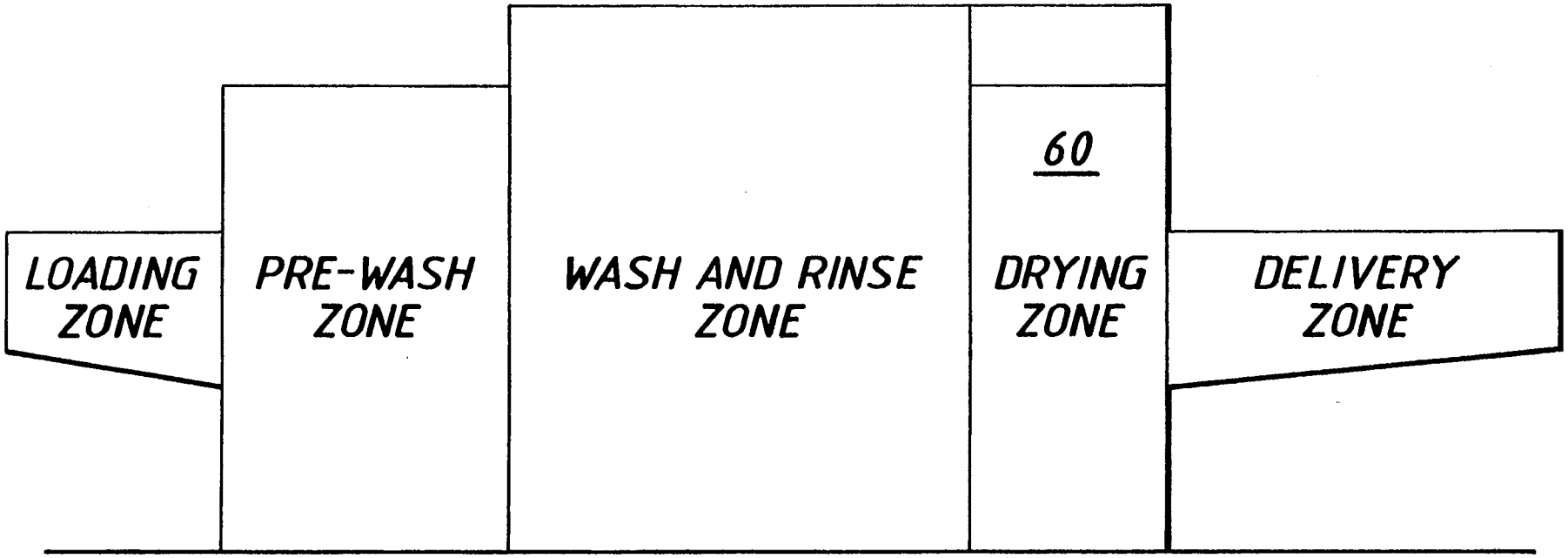

Applicants above-described embodiment of apparatus according to the present invention may be employed in a washing and drying machine as illustrated schematically by way of example in FIG. 7 as a drying section 60 (or as part of a drying section). Such a machine comprises washing and drying sections through which utensils to be washed and dried are conveyed sequentially.

It will be understood that various modifications and alternative embodiments may be made without departing from the scope of the invention. For example a surface combustion, radiant burner could be employed instead of the ribbon burner. However, due to the lower throughput of fuel gas possible with a radiant burner of the same physical size, a much larger radiant burner would be required to produce the same heat output as a ribbon burner. Moreover, the air directing means and/or the additional air directing means may comprise the outlet(s) or nozzle(s) of one or more blowers or fans which direct(s) air from the blower(s) or fan(s) so as to mix satisfactorily with the hot gaseous combustion products and/or over one or more surfaces of the burner casing.

I claim:

1. Apparatus for drying objects, comprising a chamber, a fully re-mixed gas-fired burner for firing into chamber, at least one air delivering means located upstream of the burner for delivering air into the chamber, means for directing air from the at least one air delivering means to mix with hot gaseous combustion products producted by the burner, and a region for receiving objects to be dried, the chamber having a downwardly directed outlet means for directing a mixture of the combustion products and air downwardly into the region, the burner comprising a casing and the apparatus further comprising additional air directing means for directing air from the at least one air delivering means over at least one outer surface of the casing.

2. Apparatus as claimed in claim 1, in which the burner comprises a ribbon burner or a plaque burner.

3. Apparatus as claimed in claim 1, in which the burner is arranged to fire in a substantially horizontal direction into the chamber.

4. Apparatus as claimed in claim 1, in which the outlet means comprises duct means having an outlet opening.

5. Apparatus as claimed in claim 4, in which duct means tapers in the direction towards the outlet opening.

6. Apparatus as claimed in claim 1, in which the air directing means and the additional air directing means comprise deflectors for deflecting air delivered into the chamber.

7. Apparatus as claimed in claim 6, in which the or each deflector is of channel form with the mouth of the channel opening towards an associated air delivering means.

8. Apparatus as claimed in claim 7, in which the base of the channel form is concave.

9. Apparatus as claimed in claim 1 in which said air directing means and additional air directing means are located side-by-side.

10. Apparatus as claimed in claim 9, in which the side-by-side channel forms comprising the air directing means and the additional air directing means have a common side wall.

11. Apparatus as claimed in claim 1, further comprising supporting means for transporting the objects through the drying region.

12. Apparatus as claimed in claim 1 in which the burner is arranged to fire in a downwardly direction into the chamber.

13. A machine comprising a washing section and a drying section through which objects to be washed and dried, respectively, are conveyed sequentially, in which the drying section incorporates apparatus for drying the objects, said apparatus comprising a chamber, a gas-fired burner located upstream of the burner for firing into the chamber, at least one air delivering means for delivering air into the chamber, means for directing air from the at least one air delivering means to mix with hot gaseous combustion products produced by the burner, and a region for receiving objects to be dried, the chamber having a downwardly directed outlet means for directing a mixture of the combustion products and air downwardly into the region, the burner comprising a casing and the apparatus further comprising additional air directing means for directing air from the at least one air delivering means over at least one outer surface of the casing.

* * * * *